US010329816B2

(12) United States Patent
Wong

(10) Patent No.: US 10,329,816 B2
(45) Date of Patent: Jun. 25, 2019

(54) STACKING PANEL SHUTTER DOORS

(71) Applicant: GLIDEROL DOORS (S) PTE LTD., Singapore (SG)

(72) Inventor: Lok Yung Wong, Singapore (SG)

(73) Assignee: GLIDEROL DOORS (S) PTE LTD., Singapore (SG)

( * ) Notice: Subject to any disclaimer, the term of this patent is extended or adjusted under 35 U.S.C. 154(b) by 162 days.

(21) Appl. No.: 15/432,965

(22) Filed: Feb. 15, 2017

(65) Prior Publication Data

US 2017/0241177 A1 Aug. 24, 2017

(30) Foreign Application Priority Data

Feb. 18, 2016 (SG) ..... 10201601222V

(51) Int. Cl.
*E05D 13/00* (2006.01)
*E05F 1/00* (2006.01)
(Continued)

(52) U.S. Cl.
CPC ..... *E05D 13/1261* (2013.01); *E05D 13/10* (2013.01); *E05F 15/605* (2015.01);
(Continued)

(58) Field of Classification Search
CPC . E05D 15/24; E05D 13/1276; E05D 13/1284; E05D 13/1292; E05D 13/10; E05D 13/12; E05D 13/1253; E05D 13/1261; E05D 13/1269; E05Y 2900/146; E05Y 2900/106; E06B 9/0676; E06B 9/06; E05F 15/605
See application file for complete search history.

(56) References Cited

U.S. PATENT DOCUMENTS 5,172,744 A * 12/1992 Finch ..... E06B 9/15 160/133
5,636,678 A * 6/1997 Carper ..... E05D 13/1215 16/198

(Continued)

FOREIGN PATENT DOCUMENTS

| | | |
|---|---|---|
| WO | 97/44562 | 11/1997 |
| WO | 2008/047121 | 4/2008 |
| WO | 2016/003366 | 1/2016 |

OTHER PUBLICATIONS

Singaporean Search Report dated May 16, 2016 for corresponding SG patent application No. 10201601222V.

(Continued)

*Primary Examiner* — Daniel P Cahn
(74) *Attorney, Agent, or Firm* — Abelman, Frayne & Schwab

(57) ABSTRACT

A torsion spring counter balancing mechanism for a stacking panel shutter door includes one or more torsion springs one end of the or each torsion spring is fixable to a drive transmission shaft of the stacking panel shutter door, the drive transmission shaft being adapted to raise and lower the or each shutter of the stacking panel shutter door; and the other end of the or each torsion spring is fixable to a separate rotatable member of the stacking panel shutter door; whereby the mechanism is provided with means adapted to enable both the drive transmission shaft and the rotatable member to rotate, during opening and closing of the stacking panel shutter door, in such a manner as to cause respective ends of the or each torsion spring to travel at different speeds during the opening and closing sequence, which permits to keep the same size motor when panel numbers are varied.

8 Claims, 4 Drawing Sheets

(51) Int. Cl.
*E05F 15/605* (2015.01)
*E06B 9/06* (2006.01)

(52) U.S. Cl.
CPC ..... *E06B 9/06* (2013.01); *E06B 9/0676* (2013.01); *E05Y 2900/106* (2013.01); *E05Y 2900/146* (2013.01)

(56) References Cited

U.S. PATENT DOCUMENTS

| | | | | |
|---|---|---|---|---|
| 6,134,835 | A * | 10/2000 | Krupke | E05D 13/1261 160/191 |
| 2003/0201077 | A1* | 10/2003 | Mullet | E05D 15/24 160/192 |
| 2006/0137138 | A1* | 6/2006 | Mullet | E05D 13/003 16/197 |
| 2011/0108213 | A1* | 5/2011 | James | E05D 13/1261 160/231.1 |
| 2011/0314649 | A1* | 12/2011 | Kicher | B25B 27/30 29/227 |
| 2013/0314019 | A1* | 11/2013 | Wilmes | H02P 23/0063 318/470 |

OTHER PUBLICATIONS

Singaporean Written Opinion dated May 27, 2016 for corresponding SG patent application No. 10201601222V.
U.K. Search Report dated Aug. 1, 2017 for corresponding UK patent application No. GB1702457.1.

* cited by examiner

STACKING PANEL SHUTTER DOORS

CROSS REFERENCE TO RELATED APPLICATIONS

This application claims priority to SG patent application No. 10201601222V, filed Feb. 18, 2016, which is incorporated herein by reference thereto.

FIELD OF THE INVENTION

The present invention relates to an improved stacking panel shutter door, in particular to a torsion spring counter balancing mechanism for a stacking panel shutter door.

BACKGROUND ART KNOWN TO THE APPLICANT

A stacking panel shutter door consists of multiple door panels spanning the entire door width that are stacked one on top of the other when the shutter is in the closed position. When such a door shutter is actuated to open, the panels contained within opposed guide members are lifted upwards, detach from each other and upon reaching the top of the guide members that they are travelling on, they change direction and are then collected in a stacked face-to-face relationship in a console. An example of such a stacking panel shutter door is described in Singapore patent application number SG10201403775Y and inter alia, shows an operating mechanism comprising an arrangement of sprockets linked by lifting chains and powered by a motor.

As any particular set of the door panels are likely to be relatively large in size and constructed of a variety of materials (which may include glass), they can be quite heavy which will require a motor with a particularly large lifting capacity to lift each of the panels. Such a motor has to be large in size and in reality this may not be practical or even available.

Accordingly, to assist in lifting the load and thus reduce the need for a large motor, a common solution is to incorporate a counter-balancing system. Counter-balancing systems for stacking panel shutter doors that are widely-used are those that employ torsion springs such as the one described in PCT/SG2015/000132. However, the construction of the springs themselves needs to be sized according to the width and height of the door shutter as well as the weight of the door panels.

When these parameters get larger, there will be constraints in the design of the torsion springs. For example, if the height of the door shutter is particularly high, the springs will need to make more turns to accommodate the longer travel of the door panel and thus the or each spring employed will need to be longer in length. However, since the space available to accommodate the or each spring length will be limited by the width of the door, there may be insufficient space to accommodate the or each spring needed as a counter balance against the door panel weight.

Accordingly, in order to keep the same sized motor, it is an object of the present invention to try and alleviate the aforementioned problem through the provision of an improved counter-balancing system for a stacking panel shutter door that employs one or more torsion springs.

STATEMENTS OF THE INVENTION

With the foregoing in view, the invention, although embodied in several different aspects, is so linked as to form part of a single general inventive concept.

Accordingly, the invention in one aspect resides broadly in a torsion spring counter balancing mechanism for a stacking panel shutter door, whereby a) one end of the or each torsion spring is fixable to a drive transmission shaft of the stacking panel shutter door, the drive transmission shaft being adapted to raise and lower the or each shutter of the stacking panel shutter door; and b) the other end of the or each torsion spring is fixable to a separate rotatable member of the stacking panel shutter door;

and whereby the mechanism is provided with means adapted to enable both the drive transmission shaft and the rotatable member to rotate, during opening and closing of the stacking panel shutter door, in such a manner as to cause respective ends of the or each torsion spring to travel at different speeds during the opening and closing sequence.

This arrangement will meet the object of the invention as it will reduce the number of complete rotations that the or each torsion spring will need to make for a given distance of translational travel, (i.e. door height) of a shutter. The reduced number of turns is achieved by the drive transmission shaft and the separate rotatable member (i.e. both ends of the or each torsion spring) rotating, in tandem in the same direction at different rates. Thus, the or each torsion spring will make less turns than the separate rotatable member as opposed to the conventional counterbalancing design where the torsion spring will make the same number of turns as the rotatable member, enabling the torsion spring-length requirement to be reduced. Put succinctly, if the torsion spring needs to make less turns, it does not need to be as long, enabling the spring lengths to be kept as short as possible so that sufficient numbers of springs (if more than one is required) can be fitted within the space of the door width.

Preferably, the respective ends of the torsion spring are located at radii of different lengths measured from the centre of the drive transmission shaft Preferably, the rotatable member is concentric with the drive transmission shaft. Such an arrangement is likely to reduce the degree of complexity associated with the manufacture and operation of such an arrangement.

Preferably, the separate rotatable member is circular in shape. In such form, the radius of the drive transmission shaft and the separate rotatable member are different.

The rotatable member may be a band or short tube or ring which preferably surrounds the drive transmission shaft if only a single torsion spring is going to be used as a counterbalance in the mechanism. However, if multiple torsion springs are going to be used, preferably, the rotatable member is a drive transmission barrel which surrounds the drive transmission shaft. Such a barrel will extend for substantially the entire length of the drive transmission shaft. Irrespective of what type of rotatable member is used, in such form, the mechanism further comprises:

a first sprocket operatively connected to the drive transmission shaft;

a second sprocket operatively connected to the rotatable member;

wherein the first and second sprockets are operatively linked in a sequence (train).

In such form, the first sprocket is of a different size to the second sprocket. This size differential will enable the rate of rotation of the rotatable member relative to the transmission shaft to be different (and variable depending on the size of the sprocket. The arrangement of the sprockets are such that they are so sized and shaped as to enable the drive transmission shaft to make a fraction of one turn relative to the drive transmission barrel when the stacking panel shutter door is in operation.

Preferably, this fraction is a half the number of turns relative to the drive transmission barrel when the stacking panel shutter door is in operation or less. Half is particularly advantageous as a halving is a convenient way of calculating the torque in the spring design used.

Preferably, the drive transmission shaft and the separate rotatable member may be independently operable. This enables an additional number of turns to be added or subtracted to the torsion springs so that the torsion spring counter balancing mechanism can be adjusted for different door sizes.

The invention in another aspect resides broadly in a stacking panel shutter door incorporating a torsion spring counter balancing mechanism as specified hereinabove, and in such form, the invention includes within its scope, a stacking panel shutter door as specified hereinabove.

BRIEF DESCRIPTION OF THE DRAWINGS

In order that the invention may be more readily understood and put into practical effect, reference will now be made to the accompanying sheets of drawings wherein.

DETAILED DESCRIPTION OF THE PREFERRED EMBODIMENT

Figure 1:
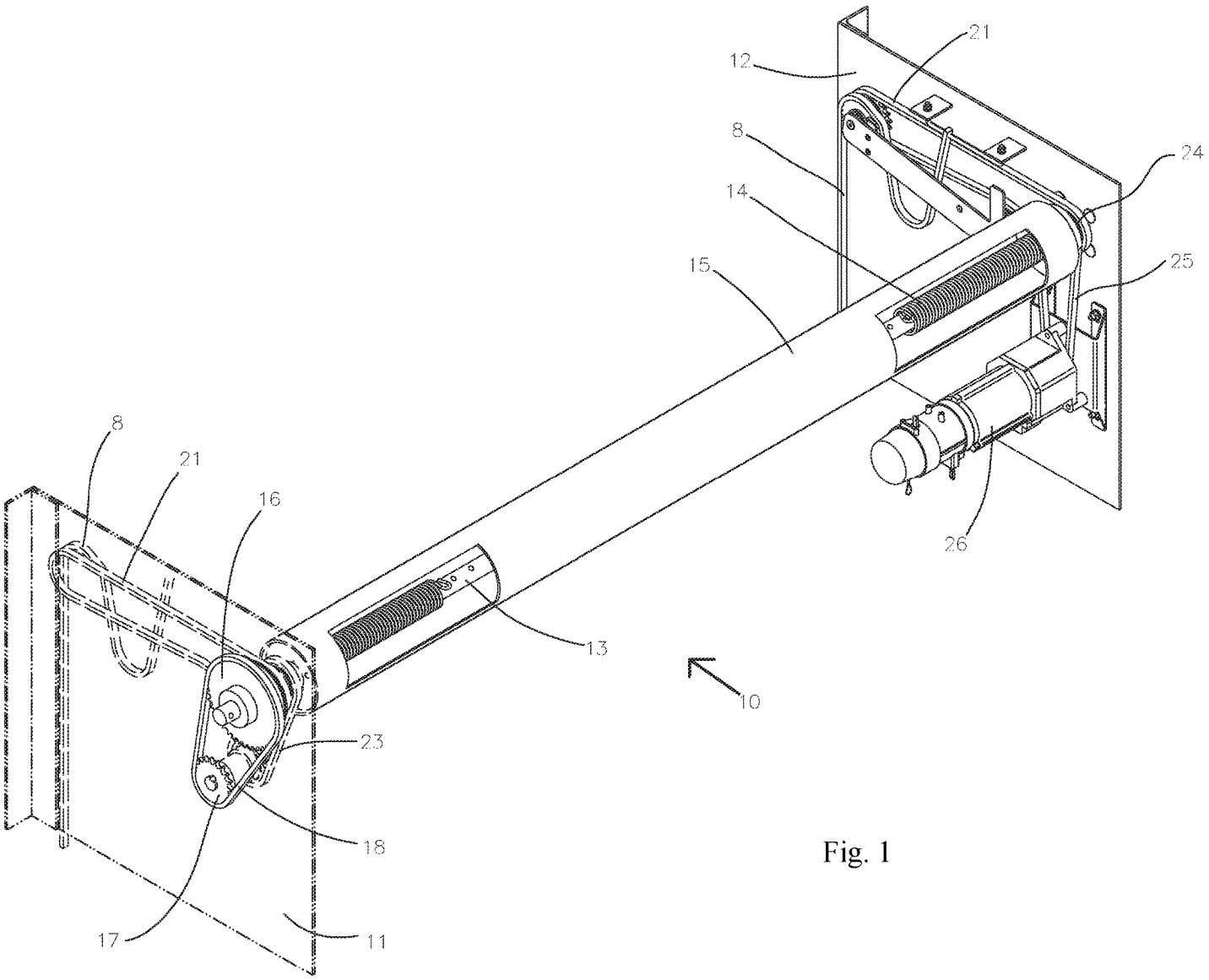
FIG. 1 is an isometric partial cut-away view of view of one embodiment of a torsion spring counter balancing mechanism fitted to a stacking panel shutter door employing a sprocket and chain mechanism, the cut-away exposing the torsion springs.
Figure 2:
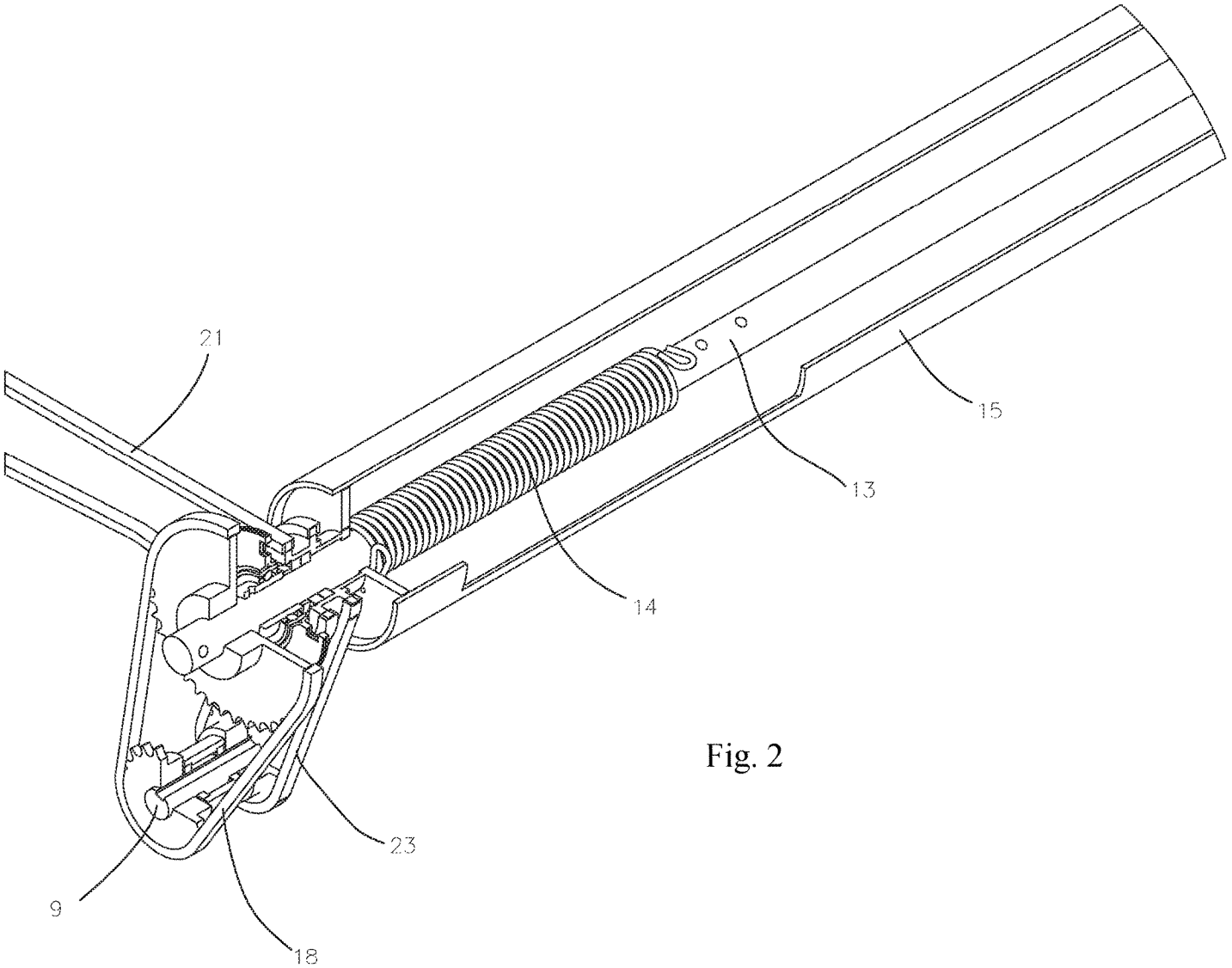
FIG. 2 is an isometric cut-away view of part of the embodiment shown in FIG. 1.

FIG. 1 shows a chain and sprocket torsion spring counter balancing mechanism forming part of a stacking panel shutter door which is generally referenced 10. Sandwiched between and fitted to opposed proximal 11 and distal 12 cassettes or shutter end plates 11, 12, is a drive transmission shaft 13 and wound around shaft 13 are a pair of torsion springs 14. One end of each torsion spring 14 is fixed to the outer circumference of the drive transmission shaft 13, and the other end of the torsion spring is fixed to a separate rotatable member 15 in the form of an elongate circular drive transmission barrel 15 that is concentric with, is independently rotatable of, and substantially completely overlies the entirety of shaft 13.

On the outermost face of the proximal plate 11, the mechanism 10 is provided with a sprocket 16, of diameter 'D' which is concentric with and fixed to shaft 13 and located elsewhere on the outermost face of the proximal plate 11, is a double sprocket 17 of diameter 'D/2' which is fitted to transmission shaft 9 and operatively connected to barrel 15. Sprocket 16 and the first sprocket of the double sprocket 17, are operatively linked in a sequence (train) by transmission chain 18.

On the innermost face of the proximal plate 11, is located a further double sprocket 19, which is again concentric with shaft 13 but this time fixed to sleeve 20 of barrel 15, both of these sprockets 19 having diameter 'D/2':

a) the first sprocket of the double sprocket 19, being linked in a sequence (train) by transmission chain 21 to double sprocket 22 to operate the stacking and un-stacking of the panels of the stacking panel shutter door 10 during opening and closing of the same, the door panel lifting chain 8 being linked to the second sprocket of double sprocket 22; and b) the second sprocket of the double sprocket 19, being linked in a sequence (train) by transmission chain 23 to the second sprocket of the double sprocket 17.

The innermost face of the distal plate 12 contains a similar sized sprocket 24 opposite double sprocket 19, but instead of it being a double sprocket, it is a single sprocket 24 and this sprocket 24 is linked in a sequence (train) by a similar transmission chain to that of chain 21 to a similar sprocket to that of sprocket 22 to similarly operate the stacking and un-stacking of the panels of the stacking panel shutter door 10 during opening and closing of the same. Also located on the innermost face of the distal plate 12 is an electric drive motor 26 and sprocket 24 and electric drive motor 26 are linked by drive chain 25.

The sprocket 16 thus forms part of a drive arrangement to turn it in the same direction as the barrel 15 and in so doing, shaft 13 will be turned in the same direction in tandem with barrel 15. The sprocket 16 is sized (D) such that it will turn at approximately half the speed of the barrel 15 (D/2). This will result in the torsion springs 14 making half the number of turns compared to the barrel 15.

Figure 3:
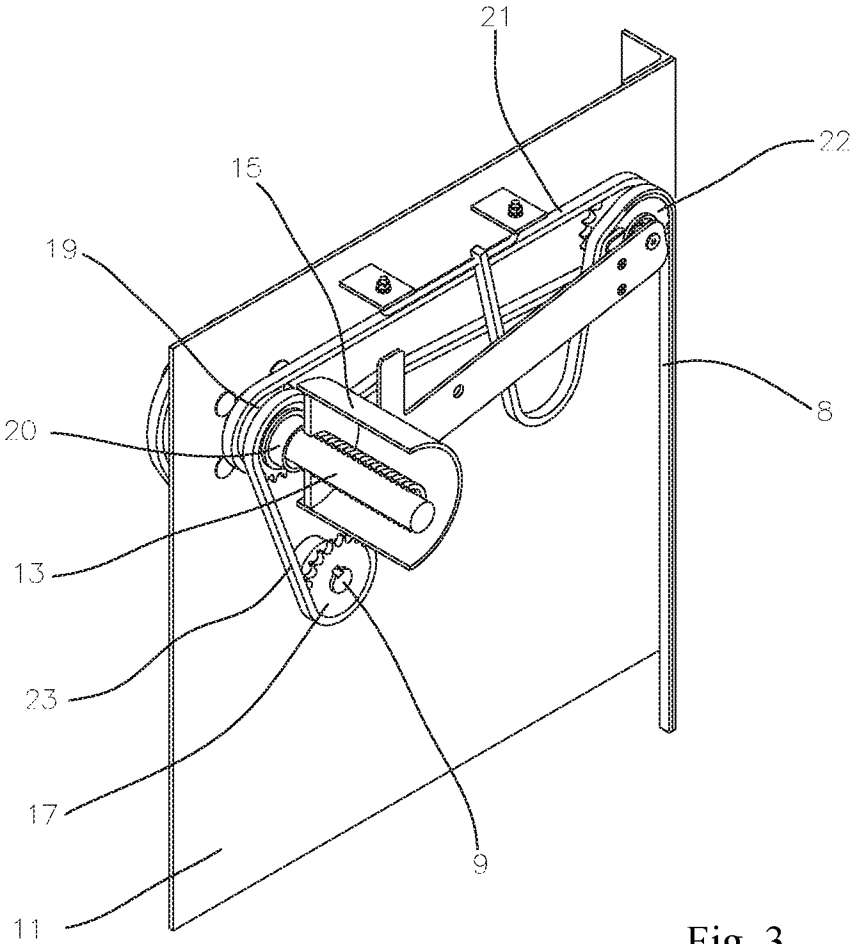
FIG. 3 is an isometric partial cut-away view of part of the embodiment shown in FIG. 1 detailing the sprocket and chain assembly which cannot clearly be seen in FIG. 1.
Figure 4:
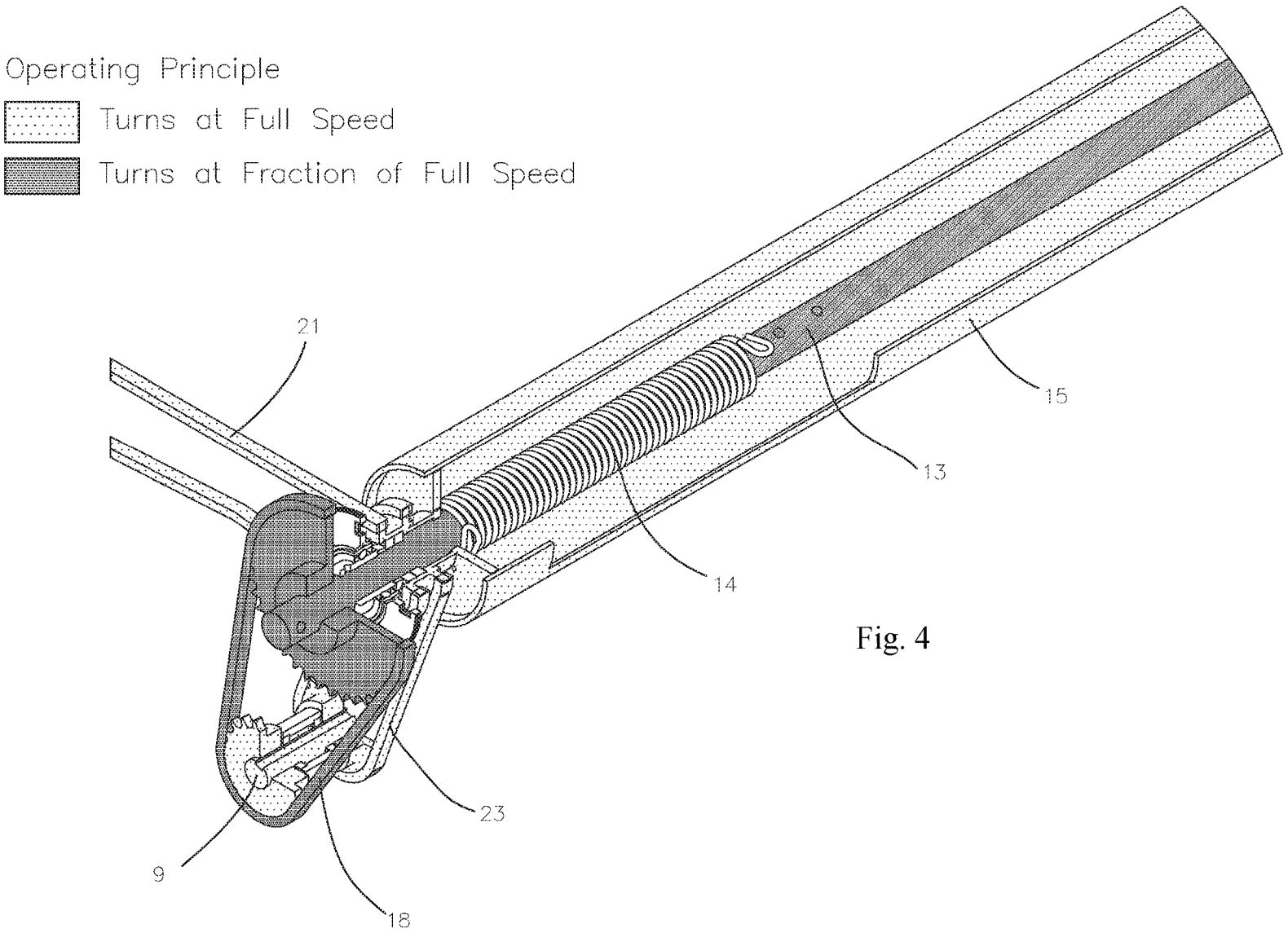
FIG. 4 uses the isometric cut-away view of part of the embodiment shown in FIG. 1 to detail those parts of the torsion spring counter balancing mechanism which, when in operation, travel at full speed and those parts relatively speaking which travel at a fraction of full speed.

From a combination of FIG. 1 and FIG. 3, it can be seen that shaft 13 and barrel 15 are only linked by transmission chain 18. If chain 18 is removed, shaft 13 and barrel 15 may be turned independently. The removal of chain 18 will enable shaft 13 and barrel 15 to be independently operable so that it is possible to add or reduce one or two spring turns that may be required to suit a given door height. To do this, chain 18 is first removed with the stacking panel shutter door 10 in the open position (which means the torsion springs 14 are at their rest position and not wound up). Using a turning bar slotted into an aperture (not illustrated) in shaft 13, shaft 13 is manually rotated to add or reduce one turn. Holding shaft 13 in this position, chain 18 is then re-attached. The end effect is that the door will start operating with springs already with one turn added or subtracted. This will enable the chain and sprocket torsion spring counter balancing mechanism forming part of a stacking panel shutter door 10 to be adjusted for each door height as each of the stacking panel shutter doors are usually custom made to fit a particular doorway as doorways come in all shapes and sizes, there being no 'industry standard' in terms of door size as each industry has its own different requirements.

In use, when the drive motor is turned on, sprocket 16 which rotates shaft 13, is driven by double sprocket 17 which is in turn rotates in tandem with barrel 15. As sprocket 16 is sized to turn shaft 13 at about half the speed of barrel 15, the result is that while barrel 15 is turning to wind up both of the torsion springs 14, shaft 13 is turning simultaneously to unwind the torsion springs 14 at about half the speed, thus approximately half neutralizing the turning effects of barrel 15.

This means that if barrel 15 makes 20 turns, shaft 13 will make only 10 turns. The torsion springs 14 will therefore also be making only 10 turns, but will be winding up to produce torque in the process. As the number of turns the torsion springs 14 need to make are about half those of a conventional torsion spring counter balancing mechanism forming part of a stacking panel shutter door, each torsion spring 14 in the present invention can be shorter in length by about half when compared with a conventional mechanism.

The benefits of the present invention may be summed up as follows:

a) more springs for a given door width can be fitted which means that the load can be shared amongst more springs enabling lighter-designed (and thus cheaper) springs to be used. In addition, this arrangement will provide a greater flexibility in the selection of spring sizes and quantities to suit a given door weight;

b) as the standard torsion spring is built to make not more than 12 turns, if more turns than that are required, such springs would have to be a custom-made adding to the cost and a manufacturer may not be able to be found that has the capability to make such springs, or even want to make them, thus the present invention frees the Applicant from the 12 turn constraint as well as the maximum workable weight of the door panels, thus limiting the types of materials that we can used on the door.

For the avoidance of doubt, the barrel 15 in all the Figs show various parts of the barrel 15 cutaway or otherwise removed, such cutaway or removed portions do not exist in reality and are purely present in the Figs to illustrate the torsion springs 14 and the drive transmission shaft 13 more clearly.

The invention claimed is:

1. A torsion spring counter balancing mechanism for a stacking panel shutter door, the mechanism comprising:

a) one end of at least one torsion spring is fixed to a drive transmission shaft of the stacking panel shutter door, the drive transmission shaft being adapted to raise and lower at least one shutter of the stacking panel shutter door; and b) a second end of the at least one torsion spring is fixed to a separate rotatable member of the stacking panel shutter door, the separate rotatable member surrounding a substantial portion of each of the at least one torsion spring and the drive transmission shaft; and, whereby the mechanism is provided with means for enabling both of the drive transmission shaft to rotate in a first direction and the separate rotatable member to rotate in tandem in the first direction, during opening and closing of the stacking panel shutter door, in such a manner to cause respective ends of the at least one torsion spring to travel at different speeds during an opening and closing sequence, the means comprising:

a first sprocket operatively connected to the drive transmission shaft; and a second sprocket operatively connected to the separate rotatable member; and, the first and second sprockets being in a spaced apart, planar parallel non-contiguous relationship and operatively linked in a sequence or train;

wherein the drive transmission shaft and the separate rotatable member rotate at different rates during the opening and closing of the stacking panel shutter door.

2. The mechanism as claimed in claim 1, wherein the separate rotatable member is circular in shape.

3. The mechanism as claimed in claim 2, wherein a radius of the drive transmission shaft and the separate rotatable member are different.

4. The mechanism as claimed in claim 1, wherein the separate rotatable member is a drive transmission barrel which surrounds the drive transmission shaft.

5. The mechanism as claimed in claim 1, wherein the first sprocket is of a different size to the second sprocket.

6. The mechanism as claimed in claim 1 or claim 4, wherein the sprockets are so sized and shaped as to enable the drive transmission shaft to make half or a fraction of a number of turns relative to the drive transmission barrel when the stacking panel shutter door is in operation.

7. The mechanism as claimed in claim 1, wherein the drive transmission shaft and the separate rotatable member may be independently operable.

8. A stacking panel shutter door, comprising a torsion spring counter balancing mechanism including at least one torsion spring, wherein a) one end of the at least one torsion spring is fixed to a drive transmission shaft of the stacking panel shutter door, the drive transmission shaft being adapted to raise and lower at least one shutter of the stacking panel shutter door; and b) a second end of the at least one torsion spring is fixed to a separate rotatable member of the stacking panel shutter door, the separate rotatable member surrounding a substantial portion of each of the at least one torsion spring and the drive transmission shaft; and, whereby the mechanism is provided with means for enabling both of the drive transmission shaft to rotate in a first direction and the separate rotatable member to rotate in tandem in the first direction, during opening and closing of the stacking panel shutter door, in such a manner to cause respective ends of the at least one torsion spring to travel at different speeds during an opening and closing sequence, the means comprising:

a first sprocket operatively connected to the drive transmission shaft; and a second sprocket operatively connected to the separate rotatable member; and, the first and second sprockets being in a spaced apart, planar parallel non contiguous relationship and operatively linked in a sequence or train;

wherein the drive transmission shaft and the separate rotatable member rotate at different rates during the opening and closing of the stacking panel shutter door.

* * * * *